US010895826B2

(12) United States Patent
Ariizumi

(10) Patent No.: US 10,895,826 B2
(45) Date of Patent: Jan. 19, 2021

(54) CONVEYANCE SCREW AND DEVELOPING APPARATUS

(71) Applicant: CANON KABUSHIKI KAISHA, Tokyo (JP)

(72) Inventor: Osamu Ariizumi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/506,091

(22) Filed: Jul. 9, 2019

(65) Prior Publication Data

US 2020/0041932 A1 Feb. 6, 2020

(30) Foreign Application Priority Data

Jul. 31, 2018 (JP) ..... 2018-144560

(51) Int. Cl.
*G03G 15/08* (2006.01)

(52) U.S. Cl.
CPC . *G03G 15/0891* (2013.01); *G03G 2215/0827* (2013.01)

(58) Field of Classification Search
CPC ..... G03G 15/0891; G03G 2215/083; G03G 2215/0833
See application file for complete search history.

(56) References Cited

U.S. PATENT DOCUMENTS

2002/0009309 A1 1/2002 Suzuki
2004/0057755 A1* 3/2004 Yamaguchi ..... G03G 15/0893 399/256
2007/0231014 A1* 10/2007 Noguchi ..... G03G 15/0822 399/254
2007/0231015 A1* 10/2007 Sakamaki ..... G03G 15/0844 399/257
2014/0235415 A1 8/2014 Nakajima et al.
2016/0085181 A1* 3/2016 Sakamaki ..... G03G 15/0893 399/257
2018/0335725 A1* 11/2018 Ariizumi ..... G03G 15/0891

FOREIGN PATENT DOCUMENTS

JP H07-333968 A 12/1995
JP H08-286480 A 11/1996
JP H09-258535 A 10/1997
JP 2002-031940 A 1/2002
JP 2010-256429 A 11/2010
JP 2014-160162 A 9/2014

* cited by examiner

*Primary Examiner* — Carla J Therrien
(74) *Attorney, Agent, or Firm* — Venable LLP

(57) ABSTRACT

A conveyance screw includes a shaft member, a first blade and a second blade each formed helically on a circumference of the shaft member. The first blade includes a first wide portion and a first narrow portion both located within an area in the axial direction where both of the first blade and the second blade are provided. The first wide portion is protruded radially outward from the shaft member to a first outer diameter. The first narrow portion is formed continuously with the first wide portion in a winding direction of the first blade around the shaft member, and is protruded radially outward from the shaft member to a second outer diameter that is smaller than the first outer diameter.

9 Claims, 13 Drawing Sheets

| INNER BLADE PORTION DIAMETER D2[mm] | OUTER BLADE PORTION DIAMETER D3[mm] | S1/S2 | PEAK VARIATION VALUE Δ [%] |
|---|---|---|---|
| 6.6 | 14 | 0.01 | 0.4 |
| 8.2 | 14 | 0.5 | 0.5 |
| 9.2 | 14 | 0.9 | 1 |
| 9.4 | 14 | 1 | 1.1 |
| 9.6 | 14 | 1.1 | 1 |
| 10.2 | 14 | 1.5 | 0.5 |
| 13.6 | 14 | 27 | 0.2 |

CONVEYANCE SCREW AND DEVELOPING APPARATUS

BACKGROUND OF THE INVENTION

Field of the Invention

The present invention relates to a conveyance screw configured to agitate and convey developer, and a developing apparatus equipped with the same.

Description of the Related Art

An image forming apparatus adopting an electrophotographic system or an electrostatic recording system supplies charged toner particles from a developing apparatus to an image bearing member to thereby develop an electrostatic latent image borne on the surface of the image bearing member into a toner image. Two-component developer containing carrier and toner is widely used as developer. The developer is agitated and circulated by conveyance screws in a container of the developing apparatus, by which toner density is uniformed and triboelectrification of carrier and toner is performed. Moreover, when toner in the container is consumed by developing images, toner is replenished from a replenishing device such as a toner bottle and is mixed with developer existing in the container by a conveyance screw.

Blade shapes as described in the following documents are proposed as conveyance screws that can be adopted in such developing apparatuses. Japanese Patent Application Laid-Open Publication Nos. H09-258535 and 2002-031940 each discloses a multithread screw having multiple threads of helical blades. Japanese Patent Application Laid-Open Publication Nos. H07-333968, H08-286480 and 2010-256429 each discloses a screw in which a portion of the helical blade is cut out so that the shape of the blade is non-continuous.

There are demands for a developing apparatus that is downsized and that can be operated with a small amount of developer. In this type of developing apparatus, it is necessary to circulate limited amount of developer efficiently to supply the necessary amount of developer stably to a developer bearing member. Further, since the ratio of amount of replenish toner with respect to the amount of developer stored in the developing apparatus is relatively high, it is necessary to agitate replenish toner efficiently and make uniform the toner density speedily.

However, none of the screw configurations disclosed in the above-described documents was able to realize highly efficient conveyance of developer and highly efficient agitation of developer in the same time.

SUMMARY OF THE INVENTION

The present invention provides a conveyance screw realizing highly efficient conveyance of developer and highly efficient agitation of developer in the same time, and a developing apparatus equipped with the same.

According to one aspect of the invention, a conveyance screw configured to agitate and convey developer includes: a shaft member; and a first blade and a second blade each formed helically on a circumference of the shaft member, an area in an axial direction of the shaft where the first blade is arranged overlapping at least partially with an area in the axial direction where the second blade is arranged, wherein the first blade includes a first wide portion and a first narrow portion both located within an area in the axial direction where both of the first blade and the second blade are provided, wherein the first wide portion is protruded radially outward from the shaft member to a first outer diameter, and wherein the first narrow portion is formed continuously with the first wide portion in a winding direction of the first blade around the shaft member, and is protruded radially outward from the shaft member to a second outer diameter that is smaller than the first outer diameter.

Further features of the present invention will become apparent from the following description of exemplary embodiments with reference to the attached drawings.

DESCRIPTION OF THE EMBODIMENTS

Now, exemplary embodiments for carrying out the present invention will be described with reference to the drawings.

First Embodiment

Figure 1:
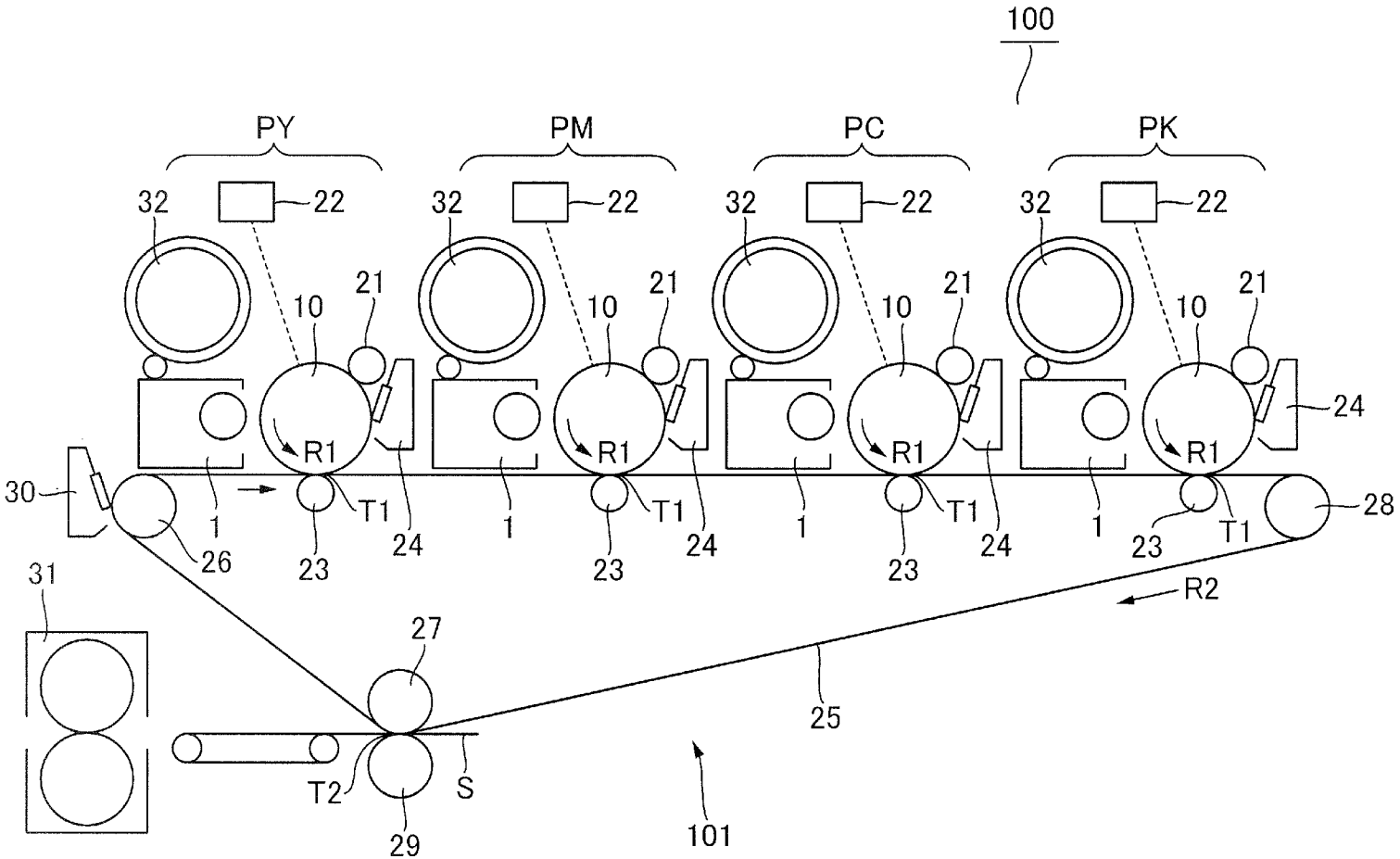
FIG. 1 is a schematic drawing of an image forming apparatus according to a first embodiment.

FIG. 1 is a schematic drawing illustrating a configuration of an image forming apparatus 100 according to a first embodiment. The image forming apparatus 100 is a full-color printer equipped with an image forming engine 101 adopting a tandem-type intermediate transfer system in which image forming units PY, PM, PC and PK are arranged along an intermediate transfer belt 25.

The respective image forming units PY through PK are image forming units that adopt an electrophotographic system and that execute electrophotographic processes to form toner images. That is, the image forming unit PY charges a surface of a photosensitive drum 10 serving as a photosensitive member, i.e., image bearing member, uniformly by a charger 21, and writes an electrostatic latent image on a drum surface by laser beams irradiated from a laser scanner 22. The electrostatic latent image is developed by toner supplied from the developing apparatus 1, by which a toner image of yellow is visualized.

A similar process is performed in parallel in the other image forming units PM, PC and PK, and toner images of respective colors of magenta, cyan and black are formed. Since the configurations of the respective image forming units PY through PK are approximately the same except for the toner color used for developing the image, the descriptions thereof are omitted. The toner images borne on the photosensitive drums 10 of the respective image forming units PY through PK are primarily transferred by a primary transfer roller 23 at a primary transfer portion T1 to the intermediate transfer belt 25. In this state, toner images of other colors are respectively transferred in a superposed manner to the yellow toner image initially transferred to the intermediate transfer belt 25, by which a full color toner image is formed on the surface of the intermediate transfer belt 25. Attached substances such as residual toner remaining on the photosensitive drum 10 without being transferred to the intermediate transfer belt 25 after transfer are removed by a drum cleaner 24.

The intermediate transfer belt 25 serving as an intermediate transfer body of the present embodiment is wound around a tension roller 26, a secondary transfer inner roller 27 and a drive roller 28, and the intermediate transfer belt 25 is conveyed in a rotational direction R2 co-rotated with the drive roller 28 along a rotation direction R1 of the photosensitive drum 10. A secondary transfer roller 29 is arranged at a position opposed to the secondary transfer inner roller 27 interposing the intermediate transfer belt 25, and a secondary transfer portion T2 is formed as a nip portion between the secondary transfer roller 29 and the intermediate transfer belt 25. Recording materials S are fed one sheet at a time from a cassette or a tray to the secondary transfer portion T2. The toner image borne on the intermediate transfer belt 25 is secondarily transferred to the recording material S by bias electric field formed at the secondary transfer portion T2. Attached substances such as residual toner remaining on the intermediate transfer belt 25 without being transferred to a recording material S after transfer are removed by a belt cleaner 30.

Thereafter, the recording material S is conveyed to a fixing unit 31. The fixing unit 31 includes a rotary member pair that nips and conveys the recording material S and a heat source such as a halogen lamp, and the fixing unit 31 heats and presses the toner image while conveying the recording material S. Thereby, the toner particles melt and then harden, by which a fixed image is formed on the recording material S. The recording material S having passed through the fixing unit 31 is discharged to the exterior of the image forming apparatus 100.

A replenishing device 32 is respectively connected to the developing apparatus 1 of each of the image forming units PY through PK. Each replenishing device 32 includes a storage container that stores developer for replenishment, and a hopper device for measuring the developer discharged from the storage container while replenishing the developer to the developing apparatus 1. The developer stored in each storage container contains color toner corresponding to the color of the respective image forming units PY through PK. As described later, the replenishing device 32 performs operation to replenish developer to the developing apparatus 1 based on a detection signal from a toner density sensor provided on the developing apparatus 1.

The configuration of the developing apparatus and the conveyance screw described below is not limited to application in the image forming apparatus including the above-described image forming engine 101, and it is also applicable to an image forming apparatus adopting a system in which toner image is directly transferred from the photosensitive member to the recording material, for example.

Developing Apparatus

Figure 2:
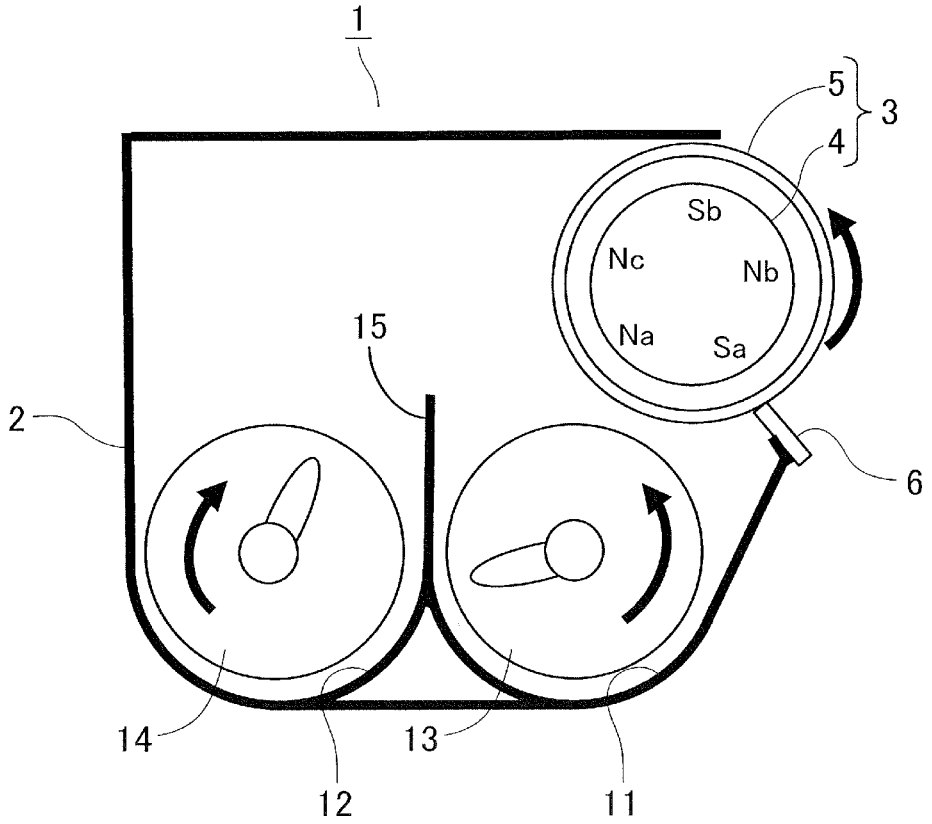
FIG. 2 is a cross-sectional view of a developing apparatus according to the first embodiment.
Figure 3:
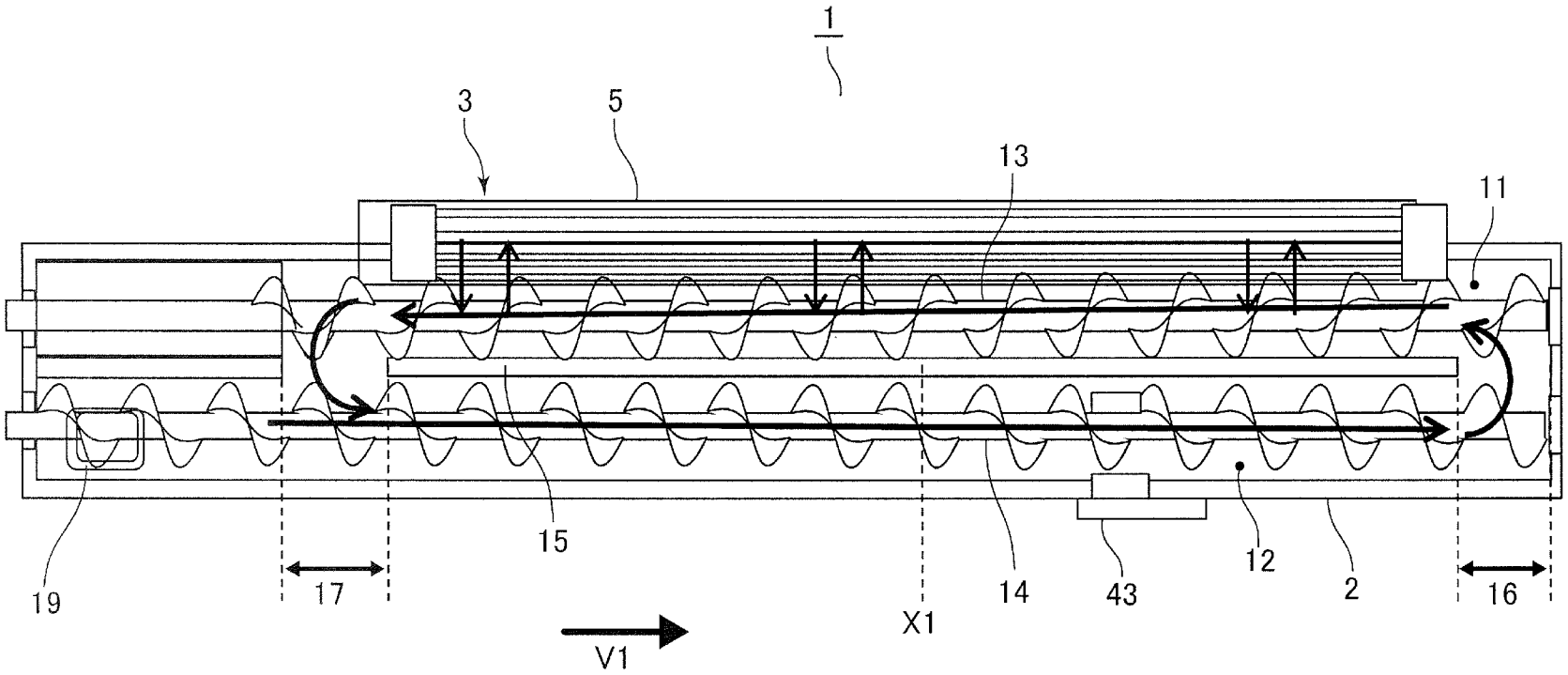
FIG. 3 is a schematic drawing illustrating an inner side of the developing apparatus according to the first embodiment from above.

The developing apparatus 1 according to the present embodiment will be described with reference to FIGS. 2 and 3. FIG. 2 is a cross-sectional view in which the developing apparatus 1 is cut along a plane vertical to a longitudinal direction, that is, axial direction of the photosensitive drum 10, and FIG. 3 illustrates a state viewing an inner side of the developing apparatus 1 from above.

As illustrated in FIG. 2, the developing apparatus 1 includes a developer container 2, a developing roller 3 composed of a developing sleeve 5 and a magnet roller 4, a blade 6, a developing screw 13, and an agitating screw 14. The developer container 2 is a container for storing developer according to the present embodiment, and the developing sleeve 5 is a developer bearing member that bears developer according to the present embodiment. The agitating screw 14 is a conveyance screw that agitates and conveys developer according to the present embodiment, and it is also a second conveyance screw while the developing screw 13 serves as a first conveyance screw.

A developing chamber 11 serving as a supplying conveyance path that supplies developer to the developing sleeve 5 and an agitating chamber 12 serving as an agitating conveyance path that constitutes a circulation path of developer with the developing chamber 11 are provided inside the developer container 2. The developing chamber 11 and the agitating chamber 12 are spatially partitioned by a partition member 15 serving as a partition wall of the present embodiment. The developing chamber 11 serves as a first chamber of the container according to the present embodiment, and the agitating chamber 12 serves as a second chamber of the container according to the present embodiment.

The developing roller 3 is composed of the magnet roller 4 having a cylindrical shape and fixed to the developer container 2, and the developing sleeve 5 that rotates around the magnet roller 4. The magnet roller 4 serving as a magnetic field generator includes magnetic poles (Na, Nb, Nc, Sa, Sb) arranged at multiple positions in a circumferential direction. The developing sleeve 5 is driven to rotate in a direction of the arrow in the drawing and conveys developer that has been attracted at the position corresponding to an attracting pole Na toward a developing area in which the developing roller 3 and the photosensitive drum 10 face each other. The blade 6 is a doctor blade that regulates thickness of developer raised in a bristle state near a magnetic pole Sa arranged between the attracting magnetic pole Na and a developing magnetic pole Nb and controls the amount of developer reaching the developing area.

The developer reaching the developing area forms a magnetic brush in which carrier is aligned in radial directions of the developing roller 3 by magnetic field generated by the developing magnetic pole Nb. In this state, toner particles fly toward the photosensitive drum under bias voltage applied to the developing sleeve 5 and electric potential distribution on the drum surface. Thereby, charged toner particles are supplied to the photosensitive drum, and electrostatic latent image on the drum surface is visualized as toner image. After development of image, developer is peeled off from the developing sleeve 5 at a non-magnetized area between a peeling magnetic pole Nc and the attracting magnetic pole Na and returned to the developing chamber 11.

Two-component developer is used in the present embodiment, and the developer stored in the developer container 2 contains nonmagnetic toner of negative charge polarity and magnetic carrier of positive charge polarity. Nonmagnetic toner is formed by including coloring agent and wax component in resin such as polyester or styrene acryl, powdering the same by pulverization or polymerization, and adding fine powder of titanium oxide, silica and the like to a surface thereof. Magnetic carrier is formed by applying resin coating on a surface of cores formed of ferrite particles or resin particles kneaded with magnetic powder. The toner density, that is, ratio of weight of toner the with respect to total weight of developer, i.e., toner-developer ratio (TD ratio), of developer in a new state, i.e., initial state, that has not yet been used for development is set to 10% according to the present embodiment.

The developing apparatus 1 is configured to perform toner replenishment with toner from the replenishing device 32 described earlier to compensate for the reduction of toner density accompanying toner consumed by developing image. A replenishing port 19 (refer to FIG. 3) which is an opening portion through which the agitating chamber 12 is communicated with the exterior of the developing apparatus 1 is provided on the developer container 2. The replenishing device 32 replenishes toner to the developing apparatus 1 through the replenishing port 19.

As illustrated in FIG. 3, developer is agitated by the developing screw 13 and the agitating screw 14 while being conveyed in circulation in the developing chamber 11 and the agitating chamber 12 within the developer container 2. The partition member 15 includes a first communication port 16 that allows developer to flow from the agitating chamber 12 to the developing chamber 11, and a second communication port 17 that allows developer to flow from the developing chamber 11 to the agitating chamber 12. The replenishing port 19 is arranged upstream of the second communication port 17 in a developer conveyance direction V1 in the agitating chamber 12. Toner falling into the agitating chamber 12 through the replenishing port 19 is conveyed while being mixed with surrounding developer by the agitating operation of the agitating screw 14 and the developing screw 13. Thereby, toner density in the developer container 2 is uniformed, and developer in which toner and carrier has been charged through triboelectrification is supplied to the developing sleeve 5.

The developing apparatus 1 according to the present embodiment adopts a so-called ACR (Auto Carrier Refresh) technology in which a small amount of developer is discharged at a time from the developer container 2 and developer that contains carrier is replenished from the replenishing device 32 to gradually replace the carrier in the developer container. Generally, the developing method using two-component developer is characterized in that toner receives smaller stress compared to the developing method using a one-component developer composed of magnetic toner. Since the surface area of carrier in the developer is greater than toner, initially, soiling of carrier caused by toner adhering to the carrier surface does not often occur. However, after long term use, soiling, i.e., spent toner, adhered to the carrier surface increases, along with which the ability of carrier to charge the toner gradually deteriorates. As a result, the problem of fogging, referring to image defects caused by toner having a small amount of charge adhering thinly on a white background portion, or toner scattering occurs. It may be possible to increase the amount of carrier filled in the developer container 2 to realize long service life of the developing apparatus 1, though it may not be preferable since it leads to increase in size of the developing apparatus.

The developing apparatus 1 having the ACR configuration is actually equipped with a discharge port for discharging developer from the developer container 2. The discharge port is provided at a predetermined height from a bottom surface of the developing chamber 11 or the agitating chamber 12, and if surface level of developer in the container exceeds a predetermined height, excessive developer is discharged through the discharge port. By balancing the amount of carrier replenished from the replenishing device 32 and the amount of carrier discharged from the discharge port, an average value of cumulative period of use of respective carrier particles stored in the developer container 2 is converged to a fixed value. Thereby, charging property of carrier can be maintained roughly constantly, which contributes to improved stability of image quality.

Conveyance Screw

Figure 4:
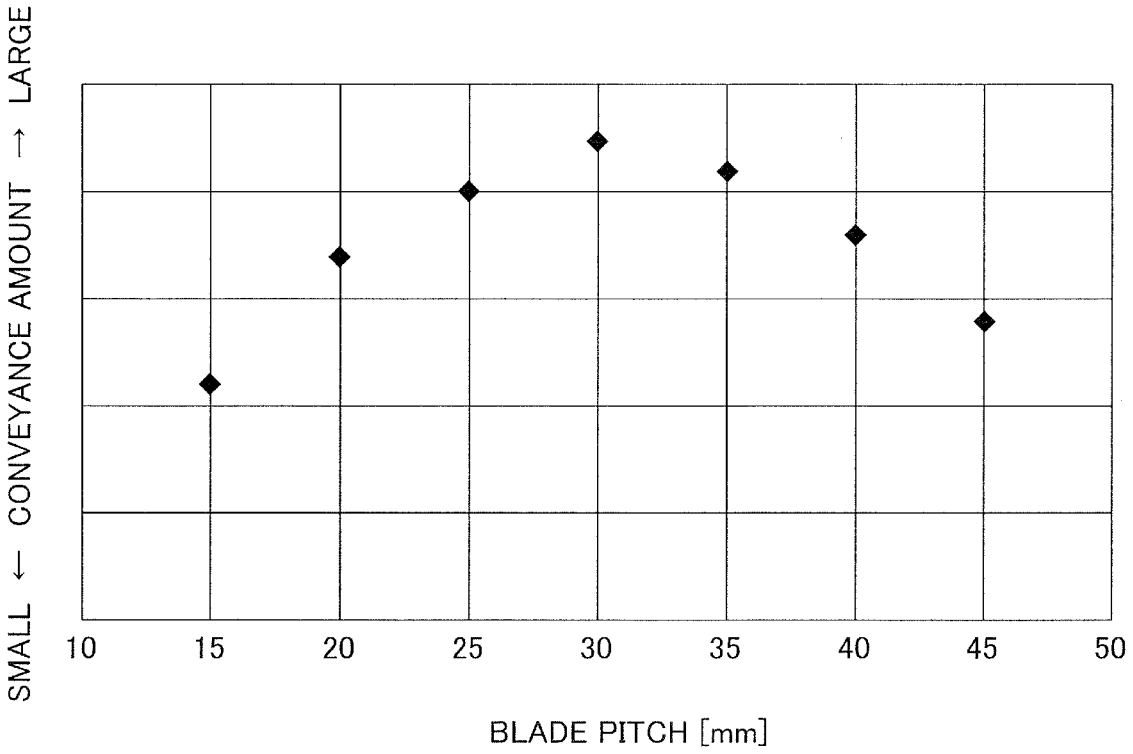
FIG. 4 is a graph illustrating a relationship between a pitch of a blade on a single-thread screw and a conveyance performance of developer.

Now, a general relationship between conveyance screw pitch and conveyance performance will be described. FIG. 4 is a graph showing a relationship between a pitch of helical blade of the conveyance screw and a developer conveyance amount per rotation, wherein test results using a single-thread screw having an outer diameter of 14 mm as an example of a conveyance screw are illustrated. As illustrated in FIG. 4, normally, the developer conveyance amount per rotation with respect to the conveyance screw pitch shows a curved graph that is convex upward. In the case of this conveyance screw, the developer conveyance amount per rotation was greatest when the pitch was 30 mm.

Figure 5:
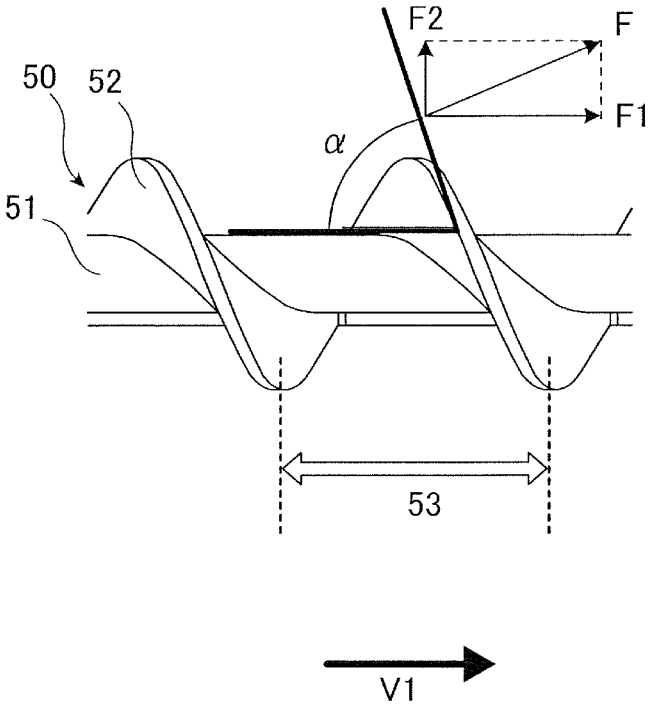
FIG. 5 is a view illustrating why the result of FIG. 4 is acquired.

The reason why such phenomenon is observed will be described with reference to FIG. 5. A conveyance screw 50 includes a screw shaft 51 and a helical blade 52. A pitch 53 is a length in an axial direction, that is, developer conveyance direction V1, in which the blade 52 circles once around the screw shaft 51. If it is assumed that all developer existing in one pitch of blade 52 is conveyed along with the apparent movement of the blade 52 accompanying the rotation of the screw shaft 51, the distance in which the developer advances per rotation of the conveyance screw 50 is equal to the pitch 53. However, developer actually moves in a manner slipping on the surface of the blade 52, and not all the developer is conveyed along with the movement of the blade 52.

In a state where the pitch is gradually widened, angle $\alpha$ of the blade 52, that is, angle in which a spiral line formed by a radially outward end portion of the blade 52 crosses a rotational axis of the screw if viewed in a direction vertical to the axial direction, becomes smaller. Then, while component F2 directed outward in a radial direction contained in a normal vector F of the conveyance surface of the blade 52 increases, component F1 that is parallel to the axial direction decreases. Therefore, if the pitch 53 is too wide, a major portion of rotational energy of the conveyance screw 50 will be consumed in a work of pushing the developer radially outward by the blade 52, and the ability to convey the developer along the axial direction is relatively deteriorated. Meanwhile, if the pitch 53 is too narrow, the angle α is increased so that the blade 52 can move the developer efficiently in the axial direction, but since a moving amount of the blade 52 in the axial direction per rotation is small, the conveyance performance is also deteriorated. As a result, as illustrated in FIG. 4, a convex curve as illustrated in FIG. 4 is observed where conveyance performance becomes maximum when the pitch 53 is set to an appropriate value.

Now, the configuration of the agitating screw 14 according to the present embodiment will be described.

In the present embodiment, a multithread screw in which multiple threads of helical blades are provided, that is, a screw in which a plurality of blades are present in a cross section vertical to the axial direction, is adopted as the agitating screw 14. A multithread screw includes multiple threads of helical blades, so that the number of blades that passes one point near the screw when the screw rotates once increases, and as a result, the conveyance performance of developer is improved. In other words, in a single-thread screw, even if the angle α of the blade 52 is set to an appropriate value as described above, the developer slips on the conveyance surface of the blade 52 and the conveyance performance is limited, whereas if multiple threads of blades are provided, the conveyance performance is improved. Further, by adopting a multithread screw, the number of agitating operations that the developer in the agitating chamber 12 receives while the screw rotates once is increased, so that agitation performance of the agitating screw 14 is expected to be improved. Agitation performance refers to an ability to rub toner and carrier together to be charged through triboelectrification, and an ability to mix toner replenished from the replenishing port 19 with the surrounding developer to make uniform the toner density speedily.

Figure 6:
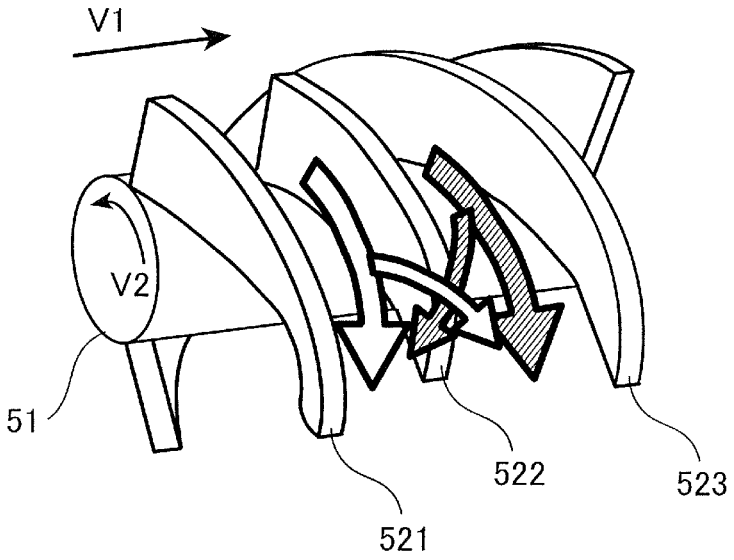
FIG. 6 is a schematic diagram illustrating a multithread screw having a cutout portion.

Further according to the present embodiment, the respective threads of blades of the multithread screw are configured to have cutout portions in which portions of the blade in the axial direction are cut out. That is, as illustrated in FIG. 6, at least one blade 522 among the multiple blades of the multithread screw has a cutout portion, that is, a discontinued portion in which a radially outward end portion of the blade is discontinued. The blade 522 in the drawing is a blade having a cutout portion, and blades 521 and 523 are blades that are respectively positioned on an upstream side and a downstream side in the conveyance direction V1 with respect to the cutout portion.

Provided with such cutout portion, the developer separated by the blade is merged at the cutout portion and then separated again by the blade, so that the developer is agitated efficiently. That is, in a state where the screw shaft 51 rotates in the arrow direction in the drawing, a chunk of developer (white arrow) existing on one side of the blade 522 and another chunk of developer (black arrow) existing on the other side thereof merge at the cutout portion and are mixed. Thereafter, the developer is separated again by the portion of the blade 522 without the cutout portion. By repeating such merging and separating of developer along with the rotation of the screw shaft 51, developer is efficiently agitated, and for example, toner replenished from the replenishing port 19 is speedily mixed with surrounding developer.

By the way, according to studies performed by the present inventors, if the screw having such cutout portions in the blade is used, there was a tendency that conveyance speed of developer near the screw shaft 51 at the cutout portion is reduced and developer tended to stay near the circumference surface of the screw shaft 51. If conveyance speed of developer by the agitating screw 14 is even partially lowered, the ratio of amount of developer existing in the developing chamber 11 is reduced with respect to the total amount of developer stored in the developer container, so that supply efficiency of developer to the developing sleeve 5 is deteriorated. In order to stably supply developer to the developing sleeve 5, the amount of developer in the container, especially the amount of carrier in the initial state, is required more, which leads to increase of manufacturing costs and maintenance costs as well as increase of driving load of the screw.

Further, by occurrence of stagnation of developer near the screw shaft in the cutout portion, developer may stick on the surface of the screw shaft 51. If sticking (or, fusion) of developer occurs, the shape of the agitating screw 14 is substantially changed, by which conveyance performance or agitation performance of developer may be obstructed. Such sticking of developer tends to occur in a state where developer in the developing apparatus 1 is degraded after long term use.

Figure 7A:
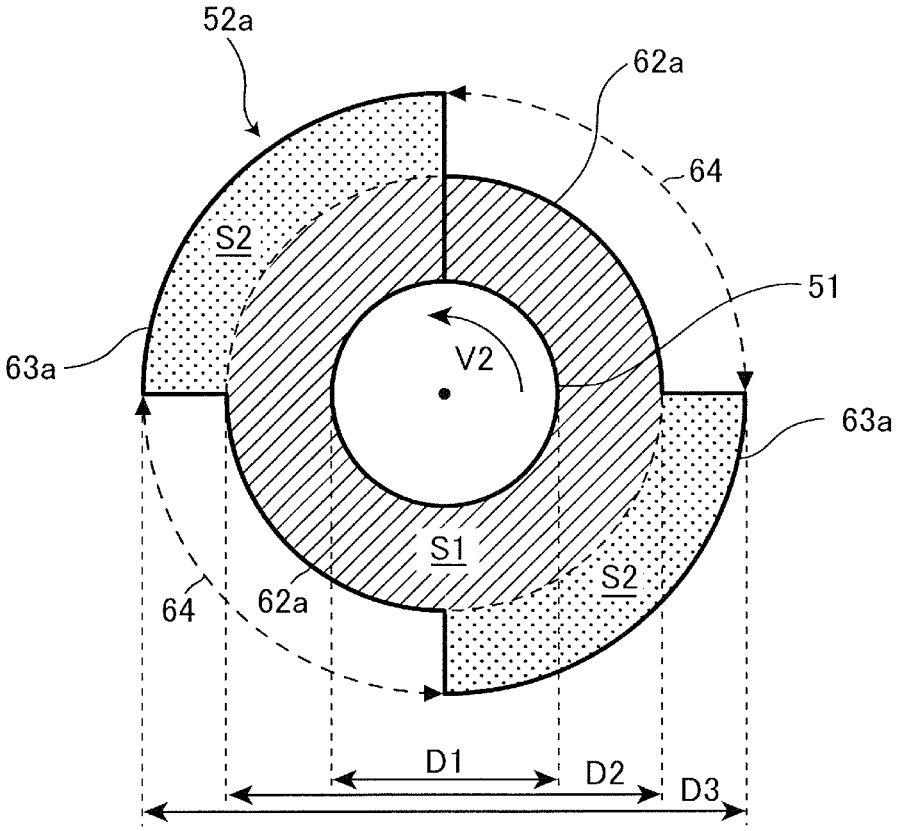
FIG. 7A is a cross-sectional view illustrating an agitating screw according to the first embodiment.
Figure 7B:
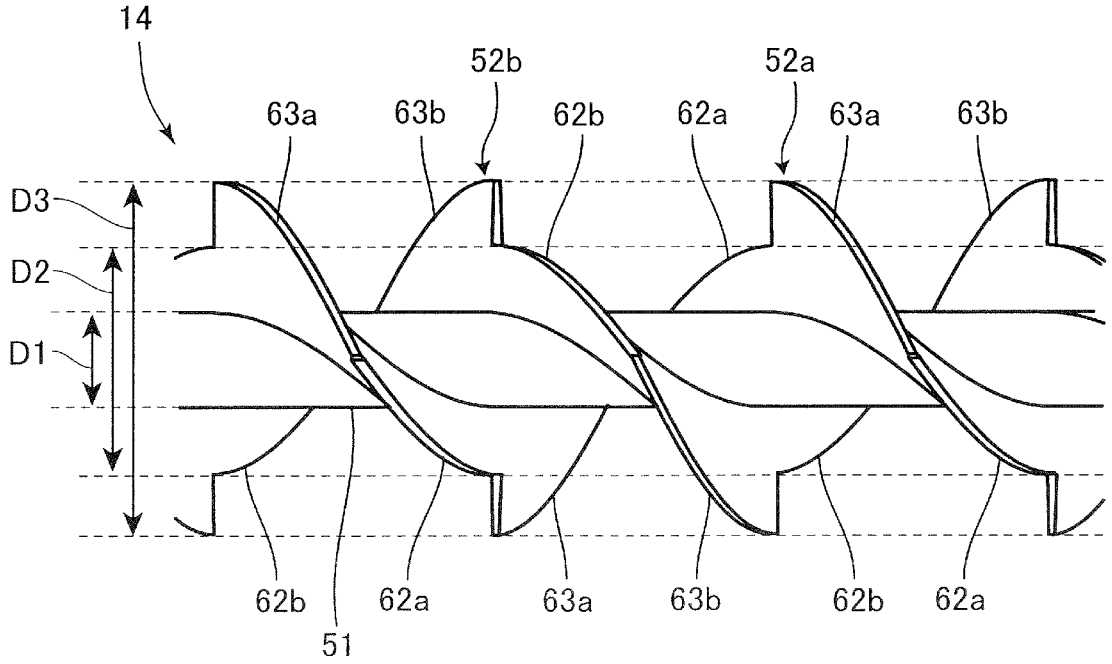
FIG. 7B is a side view of the same.

Therefore, according to the present embodiment, narrow blade portions (62*a*, 62*b*) having a smaller outer diameter (D2) than a maximum outer diameter (D3) of the blade are provided at cutout portions 64 of the blade of the screw, as illustrated in FIGS. 7A and 7B. However, FIG. 7A is a schematic diagram in which one thread of the multiple threads of blades of the agitating screw 14 is viewed in the axial direction, and FIG. 7B is a side view of the agitating screw 14. Specifically, a two-thread screw having two threads of blades is adopted as the agitating screw 14, and the respective blades 52*a* and 52*b* are provided with outer blade portions 63*a* and 63*b* having a relatively large outer diameter D3 and inner blade portions 62*a* and 62*b* having a relatively small outer diameter D2 in a mixture. The outer blade portion 63*a* and the inner blade portion 62*a* constituting the blade 52*a* are formed continuously in a winding direction of the blade 52*a* with respect to the screw shaft 51. Similarly, the outer blade portion 63*b* and the inner blade portion 62*b* constituting the blade 52*b* are formed continuously in a winding direction of the blade 52*b* with respect to the screw shaft 51.

The screw shaft 51 is a shaft member according to the present embodiment, the blade 52*a* is a first blade according to the present embodiment, and the blade 52*b* is a second blade according to the present embodiment. Each outer blade portion 63*a* is a first wide portion according to the present embodiment that protrudes radially outward from the shaft member to a first outer diameter, and Each inner blade portion 62*a* is a first narrow portion according to the present embodiment that protrudes radially outward from the shaft member to a second outer diameter that is smaller than the first wide portion. Further, each outer blade portion 63*b* is a second wide portion of the present embodiment that protrudes radially outward from the shaft member to a third outer diameter, and each inner blade portion 62*b* is a second narrow portion according to the present embodiment that protrudes radially outward from the shaft member to a fourth outer diameter that is smaller than the second wide portion. In the present embodiment, the first outer diameter and the third outer diameter are substantially equal (D3), excepting fabrication tolerance, and the second outer diameter and the fourth outer diameter are also substantially equal (D1).

Figure 8A:
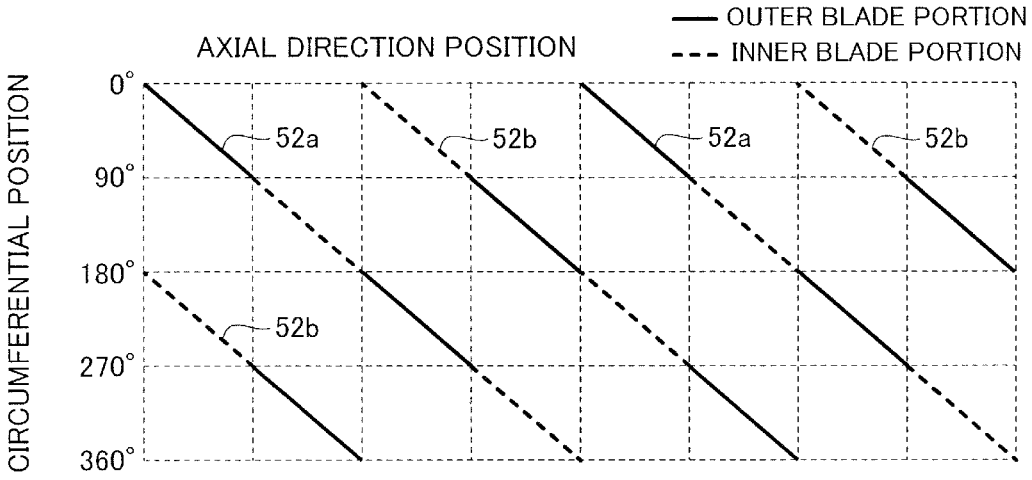
FIG. 8A is a schematic diagram illustrating an arrangement of blades of an agitating screw according to the first embodiment.

FIG. 8A is a schematic diagram illustrating an arrangement of the blades of the agitating screw 14. The solid line in the drawing shows the outer blade portions 63*a* and 63*b*, and the broken line shows the inner blade portions 62*a* and 62*b*. In the drawing, the respective blades 52*a* and 52*b* are designed so that the plurality of outer blade portions 63*a* and 63*b* and the plurality of inner blade portion 62*a* and 62*b* are arranged alternately every 90 degrees in the rotation direction. Accordingly, the outer blade portions 63*a* and 63*b* and the inner blade portion 62*a* and 62*b* appear cyclically per fixed rotation angle, which is 180 degrees according to the present embodiment, in the rotation direction of the screw shaft 51. That is, the blades 52*a* and 52*b* each includes multiple wide portions and multiple narrow portions, and each has a repetitive portion in which a repeating unit, defined by one of a plurality of wide portions and one of a plurality of narrow portions adjacent each other in the winding direction of the shaft member, are repeatedly disposed per angle of 360 degrees or smaller in terms of the rotation direction of the shaft member.

As described, by providing inner blade portions 62*a* and 62*b* having smaller outer diameters at discontinued portions, i.e., cutout portions 64, where radially outward end portions of the blades 52*a* and 52*b* are discontinued, it becomes possible to suppress the stagnation of developer near the screw shaft 51 at the discontinued portion. Thereby, it becomes possible to increase average conveyance speed of developer in the agitating chamber 12 while ensuring improved efficiency of agitation performance by providing the discontinued portions, so that developer can be supplied efficiently to the developing sleeve 5. Further, since the sticking of developer to the screw shaft 51 is avoided, the conveyance performance and the agitation performance of the agitating screw 14 can be maintained for a long period of time.

In the cross-section vertical to the axial direction, the blades 52*a* and 52*b* are arranged at opposite phases interposing the screw shaft 51. In such configuration, in a case where the outer blade portion 63*a* or 63*b* of a first blade is arranged at a certain position in the axial direction, it is preferable to have the inner blade portion 62*a* or 62*b* of a second blade positioned at the same position in the axial direction. In other words, it is preferable to have a position of the first wide portion (63*a*) overlap with the position of the second narrow portion (62*b*) in the axial direction, and have a position of the second wide portion (63*b*) overlap with the position of the first narrow portion (62*a*) in the axial direction. Such arrangement suppresses variation according to axial direction position of force in the conveyance direction V1 that the developer receives from the agitating screw 14 and contributes to the improvement of conveyance performance.

Further, the preset embodiment realizes both high conveyance performance and high agitation performance at the same time by mixing the outer blade portions 63*a* and 63*b* and the inner blade portions 62*a* and 62*b* with a given area ratio for both the blades 52*a* and 52*b*. Specifically, in consideration of test results described later, in a state where the blade 52*a* corresponding to 360 degrees in the rotation direction V2 of the screw shaft is viewed in the axial direction as illustrated in FIG. 7A, ratio (S1/S2) of inner blade area S1 to outer blade area S2 is set to satisfy the following relationship.

$$0.5 \leq S1/S2 \leq 1.5 \quad (1)$$

The inner blade area S1 refers to an area of a portion on an outer side of a circle whose diameter is the outer diameter D1 of the shaft 51 with respect to the shaft center of the screw shaft 51 and on an inner side of a circle whose diameter is the outer diameter D2 of the inner blade portion 62*a*, and the outer blade area S2 refers to an area of a portion on an outer side of the circle whose diameter is the outer diameter D2 of the inner blade portion 62*a* and on an inner side of a circle whose diameter is the outer diameter D3 of the outer blade portion 63*a*. Only one blade 52*a* is illustrated in FIG. 7A, but in the present embodiment, a similar relationship is also satisfied in the other blade 52*b*.

A configuration example of a screw satisfying the condition of expression (1) is as follows. The pitch of the respective blades 52*a* and 52*b* is set to 30 mm. The diameter of the screw shaft 51 is set to 6 mm (i.e., D1=6), the diameter of the inner blade portions 62*a* and 62*b* is set to 9.4 mm (i.e., D2=9.4), and the diameter of the outer blade portions 63*a* and 63*b* is set to 14 mm (i.e., D3=14).

Evaluation of Agitation Performance

In order to evaluate the agitation performance of developer of the agitating screw 14 configured as above, the change in measured values of the toner density by a toner density sensor 43*a* after toner replenishment through the replenishing port 19 was performed is observed (refer to FIG. 3). An inductance sensor for detecting magnetic property of the developer was used as the toner density sensor 43 to detect the toner density near the sensor.

The property of the inductance sensor used as the toner density sensor 43 will be described. The inductance sensor is a sensor that detects information related to magnetic permeability of developer, and the sensor is attached to the developer container 2 with a detection surface for detecting magnetic permeability protruded in the agitating chamber 12, that is, in a state opposed to the agitating screw 14. Further, the sensor is arranged so that the detection surface is sufficiently close to the agitating screw 14 to prevent stagnation of developer at the vicinity of the detection surface. The inventors have confirmed that if a distance between the detection surface and a trajectory of rotation of the agitating screw 14, i.e., cylindrical plane of the outer diameter D3, is referred to as "G", from the viewpoint of sensor sensitivity, the value of distance G should preferably be set within a range from 0.2 to 2.5 [mm]. However, if the sensor is positioned too close to the agitating screw 14, the possibility of the detection surface being in contact with the screw blade increases. In that case, undesirable effects such as deformation of the sensor, mixing of chipped powder caused by damage into the developer, and aggregation of developer being sandwiched between the detection surface and the blade which may lead to deterioration of developed image may appear. In consideration of these results, the distance G is set to 0.5 mm in the following evaluation test.

The toner density sensor 43 detects the magnetic permeability in a predetermined detection range from the detection surface, so that even if the toner density of developer is fixed, the magnetic permeability being detected varies along with the rotation of the agitating screw 14. Specifically, since developer passes a vicinity of the detection surface of the toner density sensor 43 along with the rotation of the screw, the detection value of magnetic permeability shows a waveform in which a maximum value and a minimum value are repeated in a cycle corresponding to the rotation cycle of the agitating screw 14.

In the present example, detection of magnetic permeability of the developer by the toner density sensor 43 is performed every 10 ms. The detected values detected every 10 ms are averaged within a predetermined time window defined by an interval from one local maximum to another local maximum of the waveform (i.e., averaged within the time required for one rotation according to a rotation speed of the agitating screw 14, for example), and the averaged value is set as a measured value of magnetic permeability of that time window.

Figure 9:
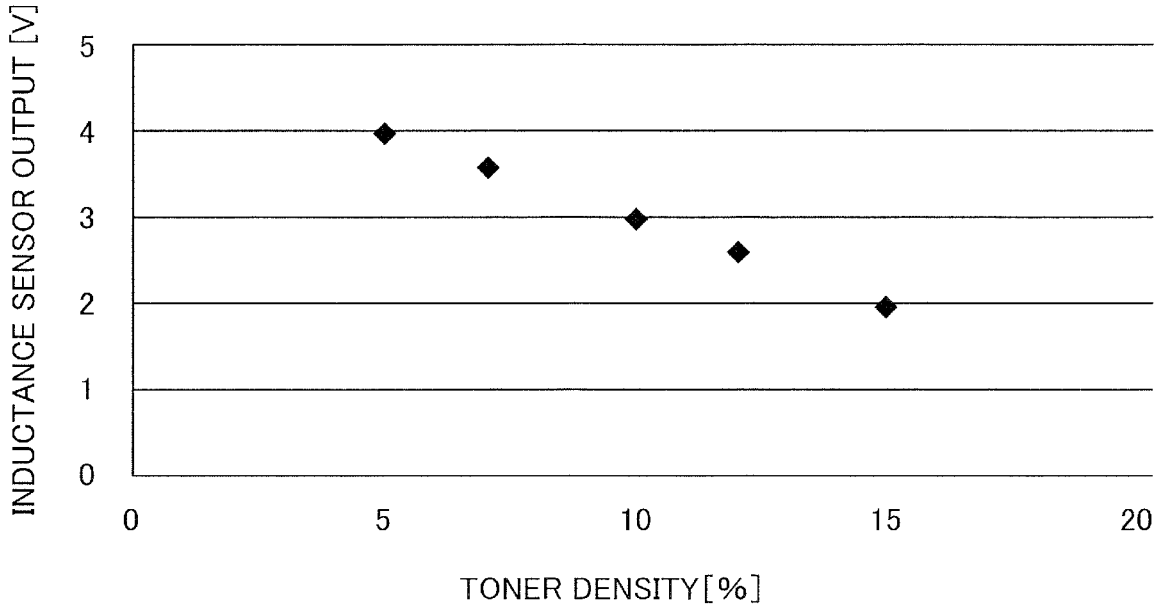
FIG. 9 is a graph illustrating a relationship between toner density and level of output signal of an inductance sensor.

As described above, the two-component developer includes magnetic carrier and nonmagnetic toner as main components. If the toner density of the developer is changed, the ratio of carrier as magnetic particles is changed, and the magnetic permeability of the developer is also changed. The change of magnetic permeability is detected by the toner density sensor 43. The electric signals output from the toner density sensor 43 changes approximately linearly according to the toner density, as illustrate in FIG. 9. That is, the values of the signals output from the toner density sensor 43 correspond to the toner density of the two-component developer stored in the developing apparatus.

Figure 10:
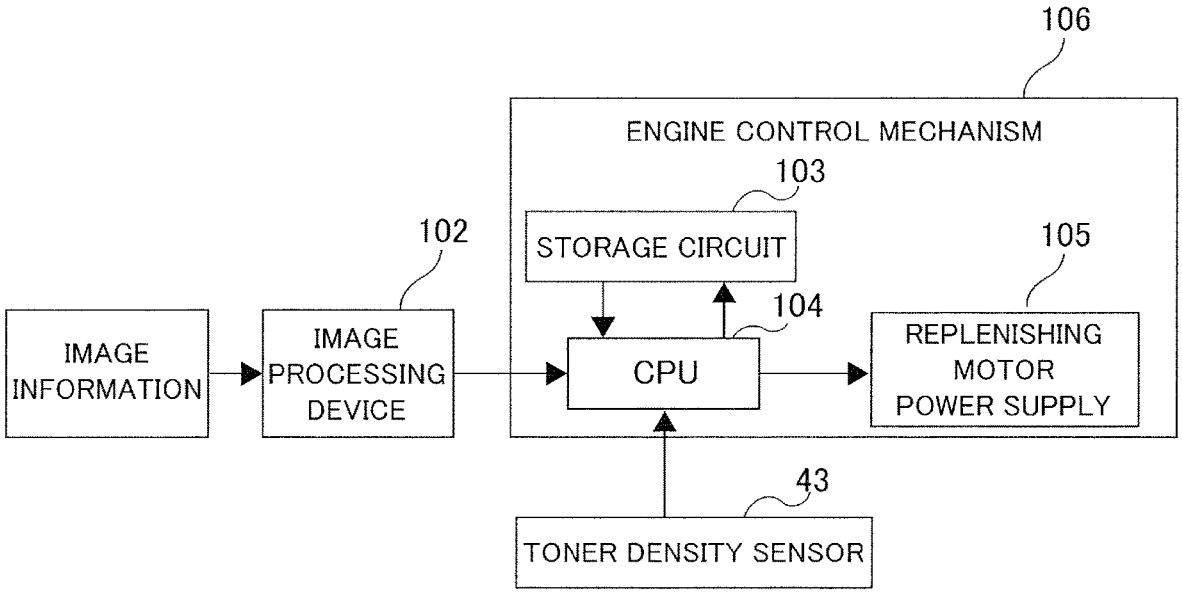
FIG. 10 is a block diagram illustrating a control configuration related to toner replenishment with respect to the developing apparatus.

Next, a circuit configuration for processing the output signals from the toner density sensor 43 is described with reference to the block diagram of FIG. 10. In FIG. 10, an engine controlling mechanism 106 is a control unit that controls the image forming engine 101 (FIG. 1). A central processing unit (CPU) 104 accesses a storage circuit 103 including a nonvolatile storage media to read a program and executes the program to control the operation of respective units of the image forming engine 101. For example, if image information and image forming command are transmitted from an external device to the image forming apparatus, an image processing device 102 of the image forming apparatus analyzes the image information and generates image data of a format capable of being processed by the engine controlling mechanism 106. The CPU 104 having received image data from the image processing device 102 executes the image forming process by carrying out a process to transmit data having expanded an image of each color of the plurality of colors into a sub-scanning direction and a main scanning direction as video signals to the laser scanners 22 of the respective image forming units PY through PK.

The output signals from the toner density sensor 43 are transferred to the CPU 104. The CPU 104 compares the density value, that is, value of toner density stored in the storage circuit 103 as initial setting, which is defined in advance with the measured value of toner density calculated from the output signal of the toner density sensor 43. The measured value of toner density is obtained by averaging the output signals of the toner density sensor 43 that vary cyclically along with the rotation of the agitating screw 14 using the above-described method and converting the averaged signals to toner density using the corresponding relationship illustrated in FIG. 9.

Figure 11:
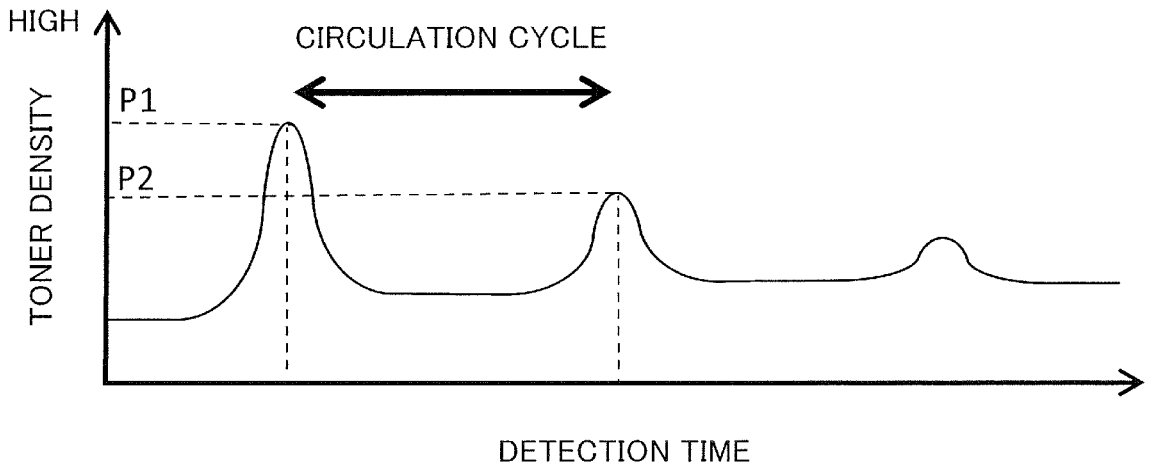
FIG. 11 is a graph illustrating a time variation of measured value of toner density after toner replenishment had been performed.

FIG. 11 illustrates a typical transition of measured value of the toner density measured by the toner density sensor 43 after toner has been replenished through the replenishing port 19. Horizontal axis shows time of detection, i.e., detection time, of magnetic permeability by the toner density sensor 43, and vertical axis shows toner density computed based on the detection result, showing a higher toner density by higher lines in the chart.

When replenish toner is replenished to the developer container 2, the toner is agitated by the agitating screw 14 and conveyed in the agitating chamber 12. When developer containing a high ratio of replenish toner reaches the vicinity of the toner density sensor 43 for the first time, the output signal of the toner density sensor 43 is varied suddenly compared to the average rate of change in a time zone during which replenishment is not performed, and the measured value of toner density temporarily shows a high value (P1). Thereafter, the agitating screw 14 conveys the developer further, by which the toner density is lowered, and the measured value is settled down close to the toner density value prior to replenishment.

After further time has elapsed, the developer containing a relatively high ratio of replenish toner passes through the developing chamber 11 and flows back to the agitating chamber 12, reaching the vicinity of the toner density sensor 43. Then, the measured value of the toner density temporarily rises again (P2) and then drops. Such processing is repeated during the circulation cycle of developer, and eventually, the toner density value is converged from the toner density value before replenishment to a value increased according to the amount of toner being replenished. The circulation cycle of developer refers to an expectation value of required time that constituent particles of developer take to circulate the circulation path formed by the agitating chamber 12 and the developing chamber 11 once.

Now, we will focus on a peak value of toner density measured using the toner density sensor 43. It means that the developer is agitated more effectively as a second peak value P2 [%] is dropped further compared to a first peak value P1 [%]. This is because as the difference between peak values P1 and P2 increases, it means that replenish toner newly replenished is mixed better with the developer already stored in the developer container 2 while the circulation cycle of developer circulates once. Hereafter, a peak variation value Δ [%] defined as difference between the first peak value P1 and the second peak value P2 is use as an index of agitation performance of the agitating screw 14.

Figure 12:
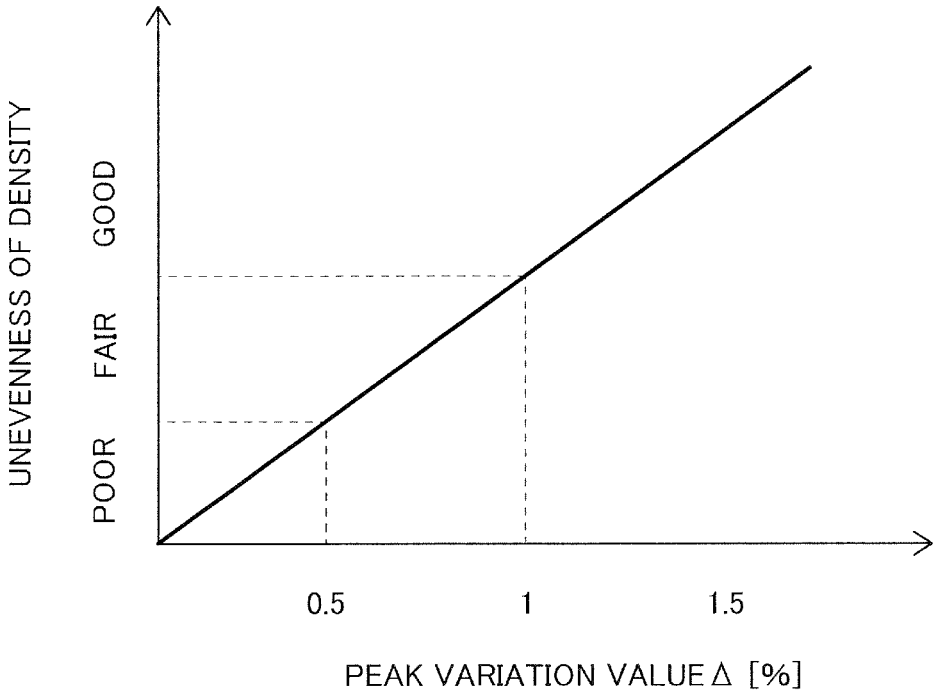
FIG. 12 is a view illustrating a relationship between peak variation value of toner density and unevenness of density of output image.

Deterioration of stability of toner density in the developer container is actualized as unevenness of density of the output image. Therefore, a developing apparatus with the agitating screw 14 composed so that the peak variation value Δ changes was mounted to the image forming apparatus, and by outputting a solid coating image, whether unevenness of density occurred or not was observed. FIG. 12 illustrates a correspondence between the peak variation value Δ of toner density and level of unevenness of density of the output image. The vertical axis shows evaluation of output image, which is "good" if there was no unevenness of density, "fair" if there was only little unevenness, and "poor" if there was much unevenness. As a result of the evaluation, unevenness of density was sufficiently suppressed when the peak variation value Δ was equal to or higher than 1.0, little unevenness occurred when the peak variation value Δ was 0.5 or higher and lower than 1, and significant unevenness of density occurred when the peak variation value Δ was lower than 0.5. It can be recognized from this result that in order to maintain stability of image quality in a state where the developing apparatus is installed in the image forming apparatus, the peak variation value Δ should preferably be 0.5 or higher, and it should more preferably be 1.0 or higher.

Next, we will describe a test performed to consider the size of the outer diameters of the inner blade portions 62*a* and 62*b* with respect to the outer blade portions 63*a* and 63*b*. At first, the developing apparatus 1 according to the configuration of the present embodiment described above was prepared, and 20 g of developer having a toner density of 10% was added as initial developer to the developer container 2. Next, in a state where the developing screw 13 and the agitating screw 14 were rotated at a speed of 600 rpm, 1 g of replenish toner was added through the replenishing port 19. Then, the measured value of toner density after adding replenish toner was acquired using the toner density sensor 43, and the peak variation value Δ of the toner density was calculated.

As for the respective samples of the agitating screw 14, the pitch of the blades 52*a* and 52*b* was set to 30 mm, the outer diameter D3 of the outer blade portions 63*a* and 63*b* was set to 14 mm, and the outer diameter D1 of the screw shaft 51 was fixed to 6 mm Meanwhile, in various samples, the outer diameter D2 of the inner blade portions 62*a* and 62*b* were set to different values within the range of 6.6 mm to 13.6 mm, and the influence on the peak variation value Δ was examined.

Figures 13A, 13B:
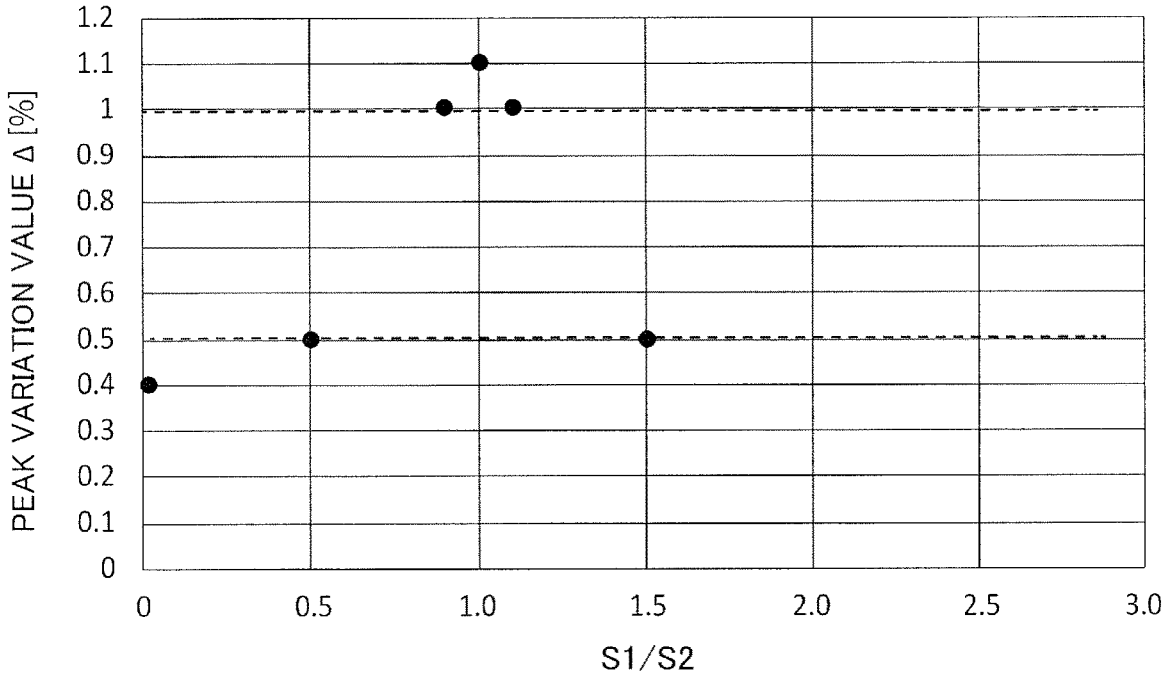
FIG. 13A is a graph illustrating a result of tests performed to compare blade shape settings of the agitating screw.
FIG. 13B is a table illustrating the result of the tests performed to compare settings of blade shapes of the agitating screw.

The results of the tests are illustrated in FIGS. 13A and 13B. FIG. 13A illustrates ratios (S1/S2) of the inner blade area S1 and the outer blade area S2 in a state where one round of the blades 52*a* and 52*b* is viewed in the axial direction, and peak variation values Δ corresponding thereto. FIG. 13B is a table showing set values of outer diameters of the inner blade portions 62*a* and 62*b*, corresponding values of S1/S2, and calculated values of the peak variation values Δ.

As the value of S1/S2 reduces, the inner blade portions 62*a* and 62*b* become smaller, and in the state where S1/S2=0, the circumference surface of the screw shaft 51 is exposed to the cutout portions 64 of the outer blade portions 63*a* and 63*b*. Meanwhile, as the value of S1/S2 increases, the closer the shape of the screw approaches a normal multithread screw without the cutout portions 64 formed therein.

As illustrated in FIGS. 13A and 13B, it has been found that the peak variation value Δ of toner density becomes maximum if the value of S1/S2 is close to 1, and the peak variation value Δ becomes small if the value of S1/S2 is either too small or too large. This is considered to be caused by the agitation of replenish toner being insufficient if the value of S1/S2 is too small due to the deteriorated conveyance performance of the developer at the vicinity of the screw shaft. Meanwhile, if the value of S1/S2 is too high, a function for merging and separating the developer of the discontinued portions, i.e., the cutout portions 64, of the blade is no longer obtained, which is considered to cause deterioration of agitation performance.

Based on the results of the tests, at least according to the present embodiment, it has been confirmed that the peak variation value Δ becomes 0.5 or higher if the outer diameter D2 of the inner blade portions 62*a* and 62*b* is set between 8.2 and 10.2 [mm] and the value of S1/S2 is set within the range of 0.5 to 1.5. As for a more preferable configuration, it has been confirmed that the peak variation value Δ would be 1.0 or higher if the outer diameter D2 of the inner blade portions 62*a* and 62*b* is set to 9.2 to 9.6 [mm] and the value of S1/S2 is set to fall within the range of 0.9 to 1.1.

Modified Example

Figure 8B:
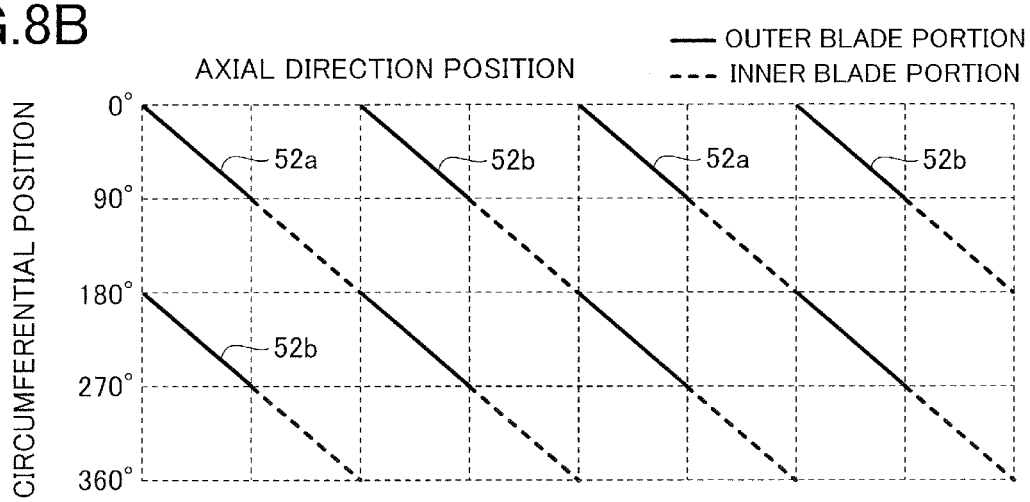
FIG. 8B is a schematic diagram illustrating the arrangement of blades of the agitating screw according to a modified example.

The dimensions of respective portions of the agitating screw 14 described above or the configuration of the developing apparatus 1 can be changed arbitrarily according to the property of the developer being used, for example, and they are not limited to the above-described values. For example, values of the pitch or thread lead of the blades 52*a* and 52*b*, the positional relationship of the blades 52*a* and 52*b* and the number of threads of the blades may be changed. As illustrated in FIG. 8B, the axial positions of the inner blade portions 62*a* and 62*b* of the blades 52*a* and 52*b* of the respective threads can be set to overlap, or partially overlap. However, at least a portion of the cutout portion, i.e., narrow portion, of the blades should be arranged within an area in the axial direction where multiple blades of the conveyance screw are provided. Further, the blade configuration of the developing screw 13 can be the same as the agitating screw 14 described above. In addition, if the developer container is equipped with a spare chamber other than the developing chamber 11 and the agitating chamber 12, in the case of a developing apparatus including three or more conveyance screws, a part of or all of the conveyance screws can be set to have the same blade configuration as the agitating screw 14 according to the present embodiment.

Although the above-described blade areas S1 and S2 are defined as areas in which the blade 52*a* corresponding to one rotation of the blade 52*a* is viewed in the axial direction, but even in a case where the cycle of arrangement of the outer blade portion 63*a* and the inner blade portion 62*a* does not correspond to 360 degrees, a configuration similar to the present embodiment can be adopted. In that case, it is preferable to arrange the outer blade portion 63*a* and the inner blade portion 62*a* cyclically per rotation angle equal to or smaller than one rotation, i.e., 360 degrees or smaller, and setting a ratio of an area s1 on the inner side and an area s2 on an outer side (s1/s2) when viewing the blade in the axial direction corresponding to one cycle, that is a repeating unit defined by one wide portion and one narrow portion arranged side by side in the winding direction of the blade, to fall within a predetermined range. In other words, it is preferable if the relationship of $0.5 \leq s1/s2 \leq 1.5$ is satisfied, and it is more preferable if the relationship of $0.9 \leq s1/s2 \leq 1.1$ is satisfied. According to such setting, a conveyance screw capable of realizing both conveyance performance and agitation performance at a high level can be provided, similar to the present embodiment.

Further, the inductance sensor described above is one example of a detection unit for detecting the toner density, and other detection units can also be used. For example, an optical sensor that irradiates light having a predetermined wavelength to the developer and detecting the change of reflection rate accompanying the change of toner density, that is, change of coverage of carrier surface by toner, can be used.

In the present embodiment, the outer blade portions 63*a* and 63*b* and the inner blade portions 62*a* and 62*b* are set to be arranged alternately across approximately the whole length of the agitating screw 14, but the present embodiment is not limited to such arrangement. That is, the blade can adopt a configuration where the inner blade portions 62*a* and 62*b* are arranged only in a portion of the axial direction, and in the remaining area, an outer diameter equal to the outer blade portions 63*a* and 63*b* without the cutout portions 64 is formed. In that case, it is preferable to adopt a configuration where at least a portion of the inner blade portion exists in the area from the replenishing port 19, i.e., opening portion, to a center position X1 of the first and second communication ports 16 and 17 (refer to FIG. 3) with respect to the conveyance direction of developer in the agitating chamber 12. According to this arrangement, replenish toner dropping through the replenishing port 19 to the vicinity of the screw shaft of the agitating screw 14 can be agitated speedily with the surrounding developer, and toner density in the agitating chamber 12 can be stabilized.

Second Embodiment

Next, a second embodiment will be described. The present embodiment adopts a configuration in which only a part of a blade among the blades of the multithread screw used as the agitating screw 14 described above has a cutout portion so that the radially outward end of the blade is discontinuous, and the remaining blades have a fixed outer diameter. Hereafter, elements having the same configuration and effects as the first embodiment are denoted with the same reference numbers as the first embodiment and descriptions thereof are omitted.

Figure 8C:
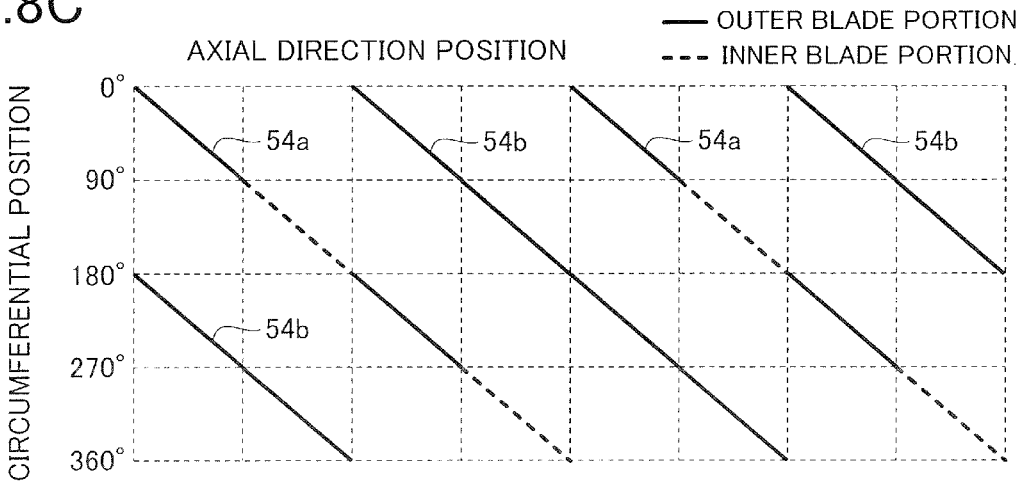
FIG. 8C is a schematic diagram illustrating the arrangement of blades of the agitating screw according to a second embodiment.

The configuration example of a conveyance screw according to the present embodiment is, as illustrated in FIG. 8C, a two-thread screw in which one blade 54*a* is formed of an outer blade portion 63*a* and an inner blade portion 62*a* which are alternately arranged, similar to the first embodiment, while the other blade has a fixed outer diameter along the whole axial direction. The setting examples of the screw configuration are as follows. The pitch of the respective blades 54*a* and 54*b* is set to 30 mm. The diameter of the screw shaft 51 is set to 6 mm, and the diameter of the outer blade portion 63*a* of the blade 54*a* and a blade 54*b* is set to 14 mm. Further, as for the blade 54*a*, the inner blade portion 62*a* having a diameter of 9.4 mm is alternately arranged with the outer blade portion 63*a*. The blade 54*a* serves as a first blade according to the present embodiment, and the blade 54*b* serves as a second blade according to the present embodiment.

By adopting such configuration, the conveyance screw enables to ensure improvement of agitation performance by the discontinued portion of the blade 54*a* similar to the first embodiment while increasing average conveyance speed of developer in the agitating chamber 12 to thereby supply developer efficiently to the developing sleeve 5. Further, since sticking of developer to the screw shaft 51 can be prevented, the conveyance performance and agitation performance of the agitating screw 14 can be maintained for a long period of time.

The present embodiments have been illustrated taking the two-thread screw as an example, but the configuration of the present embodiment can be adopted to a multithread screw having three or more threads. For example, it is possible to provide an outer blade portion and an inner blade portion to one thread of blade out of the three-thread screw, while forming the two remaining blades with a fixed outer diameter.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-144560, filed on Jul. 31, 2018, which is hereby incorporated by reference herein in its entirety.

What is claimed is:

1. A developing device comprising:

a developer bearing member configured to bear developer containing toner and carrier;

a first chamber configured to supply the developer to said developer bearing member;

a second chamber partitioned from said first chamber by a partition wall;

a first communication portion configured to permit the developer to communicate from said second chamber to said first chamber;

a second communication portion configured to permit the developer to communicate from said first chamber to said second chamber;

a first feeding screw provided in said first chamber and configured to feed the developer in a first direction from said first communication portion to said second communication portion; and a second feeding screw provided in said second chamber and configured to feed the developer in a second direction from said second communication portion to said first communication portion, said second feeding screw including a rotation shaft, a first helical blade, and a second helical blade, said first helical blade and said second helical blade being formed around said rotation shaft and forming a multiple-thread helical blade, wherein, when viewed in a direction perpendicular to a rotational axis direction of said second feeding screw, said first helical blade includes (i) a base portion that has a first outer diameter and is formed around said rotation shaft for 360 degrees in a rotation direction of said second feeding screw and (ii) an extended portion that extends radially from a part of said base portion in the rotation direction of said second feeding screw to a second outer diameter greater than the first outer diameter, said base portion and said extended portion being disposed downstream of said second communication portion and upstream of said first communication portion in the second direction, and wherein S1 is a projected area of said base portion when one pitch of said first helical blade downstream of said second communication portion and upstream of said first communication portion in the second direction is projected in the rotational axis direction of said second feeding screw, S2 is a projected area of said extended portion when one pitch of said first helical blade downstream of said second communication portion and upstream of said first communication portion in the second direction is projected in the rotational axis direction of said second feeding screw, and S1 and S2 satisfy $0.5 \leq S1/S2 \leq 1.5$.

2. The developing device according to claim 1, wherein S1 and S2 further satisfy $0.9 \leq S1/S2 \leq 1.1$.

3. The developing device according to claim 1, wherein a plurality of sets, each of which includes said first helical blade that includes said base portion and said extended portion and said second helical blade, are provided downstream of said second communication portion and upstream of said first communication portion in the second direction.

4. The developing device according to claim 1, wherein, when viewed in a direction perpendicular to the rotational axis direction of said second feeding screw, said second helical blade includes (i) a further base portion that has a third outer diameter and is formed around said rotation shaft for 360 degrees in the rotation direction of said second feeding screw and (ii) a further extended portion that extends radially from a part of said further base portion in the rotation direction of said second feeding screw to a fourth outer diameter greater than the third outer diameter, said further base portion and said further extended portion being disposed downstream of said second communication portion and upstream of said first communication portion in the second direction, wherein S3 is a projected area of said further base portion when one pitch of said second helical blade downstream of said second communication portion and upstream of said first communication portion in the second direction is projected in the rotational axis direction of said second feeding screw, S4 is a projected area said further extended portion when one pitch of said second helical blade downstream of said second communication portion and upstream of said first communication portion in the second direction is projected in the rotational axis direction of said second feeding screw, and S3 and S4 satisfy $0.5 \leq S3/S4 \leq 1.5$.

5. The developing device according to claim 4, wherein S3 and S4 further satisfy $0.9 \leq S3/S4 \leq 1.1$.

6. The developing device according to claim 4, wherein said extended portion and said further extended portion are provided so that said extended portion and said further extended portion do not overlap with each other when viewed in the rotational axis direction of said second feeding screw.

7. The developing device according to claim 4, wherein the first outer diameter and the third outer diameter are equal.

8. The developing device according to claim 4, wherein the second outer diameter and the fourth outer diameter are equal.

9. The developing device according to claim 4, wherein a plurality of sets, each of which includes said first helical blade that includes said base portion and said extended portion and said second helical blade that includes said further base portion and said further extended portion, are provided downstream of said second communication portion and upstream of said first communication portion in the second direction.

* * * * *